US006482248B1

(12) United States Patent
Holloway

(10) Patent No.: US 6,482,248 B1
(45) Date of Patent: Nov. 19, 2002

(54) ALUMINUM COMPOSITE FOR GUN BARRELS

(75) Inventor: Scott R. Holloway, N. St. Paul, MN (US)

(73) Assignee: Magnum Research, Inc., Minneapolis, MN (US)

( * ) Notice: Subject to any disclaimer, the term of this patent is extended or adjusted under 35 U.S.C. 154(b) by 1 day.

(21) Appl. No.: 09/724,220

(22) Filed: Nov. 28, 2000

(51) Int. Cl.[7] ..... F41A 21/02
(52) U.S. Cl. ..... 75/249; 75/243; 89/16
(58) Field of Search ..... 75/243, 249; 89/16; 428/615

(56) References Cited

U.S. PATENT DOCUMENTS

| | | | | |
|---|---|---|---|---|
| 2,850,828 | A | | 9/1958 | Sullivan |
| 3,571,962 | A | * | 3/1971 | Eig |
| 3,753,694 | A | | 8/1973 | Badia et al. |
| 4,235,662 | A | | 11/1980 | Reitz |
| 4,485,721 | A | | 12/1984 | Shankhla et al. |
| 4,577,431 | A | | 3/1986 | Siemers et al. |
| 4,669,212 | A | | 6/1987 | Jackson et al. |
| 4,753,154 | A | * | 6/1988 | Higashi |
| 4,824,442 | A | | 4/1989 | Cerceau |
| 4,841,836 | A | * | 6/1989 | Bundy |
| 5,045,972 | A | * | 9/1991 | Supan et al. ..... 361/387 |
| 5,130,771 | A | | 7/1992 | Burnham et al. |
| 5,410,796 | A | * | 5/1995 | Weeks, Jr. ..... 29/419.1 |
| 5,455,738 | A | * | 10/1995 | Montesano et al. ..... 361/707 |
| 5,600,912 | A | | 2/1997 | Smith |
| 5,657,568 | A | | 8/1997 | Christensen |
| 5,804,756 | A | | 9/1998 | Christensen |
| 5,915,937 | A | | 6/1999 | Christensen |
| 5,944,097 | A | | 8/1999 | Gungor et al. |

* cited by examiner

*Primary Examiner*—Ngoclan Mai
(74) *Attorney, Agent, or Firm*—Gerald E. Helget; Nelson R. Capes; Briggs and Morgan

(57) ABSTRACT

An aluminum/diamond composite for the manufacture of metal structures having high yield strength, high stiffness, high thermal conductivity, and low coefficient of thermal expansion. The composite consists of aluminum metal with included diamond particles. The volume fraction of diamond particles may range from 5% to 80%, but is most preferably about 30% to 40%. Two methods of manufacture of the composite are disclosed. The material may be used to manufacture gun barrels, rocket nozzles, cookware, heat sinks, electronics packaging, and automotive components such as brake disks, brake drums, transmission components, and engine components.

10 Claims, 5 Drawing Sheets

ALUMINUM COMPOSITE FOR GUN BARRELS

BACKGROUND OF THE INVENTION

The mode of failure of structures designed for specific end uses such as gun barrels can be determined by basic mechanisms. One such mechanism is the rate at which heat can be transferred from a surface which receives the heat through the structure to a surface which can dissipate the heat. For example, in a gun barrel the heat is received by the barrel at the barrel interior due to the burning and heat of burning of the propellant material. In addition, frictional forces of the projectile moving along and against the surface of the interior of the barrel can generate heat at the immediate surface contacted by the projectile. Where the amount of heat that can be removed from the barrel through the normal conduction mechanism is limited, this places a limit also on the application which can be made of the gun. If temperatures become excessive, the gun barrel may fail either locally at the inner surface of the gun barrel by localized melting or metal deformation at high temperature or the physical properties of the overall structure of the barrel may deteriorate resulting in a rupture.

Another mode of failure is the simple mechanical failure to contain the mechanical forces which are applied on the gun barrel. For example, as a propellant is ignited and burns it generates not only heat but also very high pressure and this pressure must be mechanically contained by the barrel. Also, where the projectile leaves its cartridge and starts down the barrel the rifling on the barrel mechanically applies a torsional force to the projectile to give it spin necessary to aid it in its accurate flight to a destination or target. Where the mechanical force needed to initiate rotation of the projectile is excessive, mechanical failure of the barrel can occur at the location adjacent the chamber where the barrel rifling starts.

The heat generated at the bore of a gun barrel can build up very rapidly in spite of the fact that heat can be transferred through the wall of the barrel to the barrel exterior because of the higher rate at which heat can be produced at the bore compared to the rate at which the produced heat can be carried by heat conduction through the thickness of the barrel wall. For a barrel wall of lower conductivity, when long bursts of firing occur, or when the heat produced by the gases is relatively high, this heat production is concentrated at the bore surface and cannot be conducted from the bore rapidly enough because of the limitations in conductivity of heat through the material of the barrel wall.

There is a heat sink effect in the thickness of the barrel but this heat sink is available only until the temperature of the barrel itself is raised by production of heat within the bore in excess of the quantity of heat which can be conducted through the wall thickness based on the characteristics of the material of the wall itself.

There is thus a need for a gun barrel with improved thermal conductivity that at the same time has great yield strength, that is, resistance to permanent deformation and fracturing.

Another reason for improved thermal conductivity is to improve the accuracy of the gun barrel. Accuracy is a function of barrel stiffness and resistance to thermal heating. That is, it is known that after firing a number of bullets through a conventional steel gun barrel, the barrel will grow quite hot. This may cause the barrel to warp, reducing the accuracy of firing. Improved stiffness of a gun barrel tends to reduce the harmonic oscillations caused by the firing of the bullet within the barrel, which also increases accuracy of firing.

There is thus a need for a gun barrel that, in addition to improved thermal conductivity and greater yield strength, has greater stiffness as measured by Young's modulus.

Finally, the material selected for the gun barrel should be as light as possible consistent with the above requirements, in order to make the weapon less heavy to carry.

Increasing the yield strength of a metal by incorporation of hard particles is known to occur. In theory, yield strength is increased by inhibiting the dislocation mobility of the native metal. Dislocations are basically points or lines or various shapes of missing atoms in a crystal structure. When a load or force is applied to the structure, those lines of missing atoms tend to move from inside the structure to the outside of the material. The more readily that such dislocations can move from the inside to the outside of the material, the lower the yield strength. Incorporation of small, hard particles into the metal puts obstacles in the way of the moving dislocations, tending to prevent such dislocations from reaching the surface of the metal, where permanent deformation and fracture can occur.

The yield strength of aluminum can be increased by the incorporation of ceramic particles such as aluminum oxide and silicon carbide. However, these materials typically have lower thermal conductivity than aluminum, and therefore are not suitable strengthening materials where the end product must have high thermal conductivity. In contrast, diamond has one of the highest thermal conductivities known: about five times that of copper. Therefore, diamond particles ought to increase both the yield strength and the thermal conductivity of a gun barrel.

There is a need for a composite gun barrel that has the same stiffness of steel at room temperature but maintains this stiffness upon heating and also transfers heat more readily and is more resistant to permanent deformation and fracture than steel at higher temperatures. The material should also have a lower coefficient of thermal expansion, so that it maintains its original shape as much as possible at higher temperatures.

While this material is well suited to gun barrels, it would also have application to any technology which requires high strength, high thermal conductivity, high stiffness, and a low coefficient of thermal expansion. Such applications may include rocket nozzles, cookware, heat sinks, electronics packaging, and automotive components such as brake disks, brake drums, transmission components, and engine components.

SUMMARY OF THE INVENTION

The objective of the present invention is an aluminum-diamond composite and a method of manufacture for the same.

The basic approach used to produce a structural composite material with high thermal conductivity is to combine pure aluminum or an aluminum alloy with industrial grade diamond particles (a common abrasive). The particles selected are preferably Type IB monocrystalline diamonds with a maximum size of 2.0 $\mu$m. Aluminum and diamond have nearly the same density, but the real advantage for this material comes from the fact that diamond is one of the stiffest, strongest, and most thermally conductive materials known. Intrinsic material properties such as Young's modulus and thermal conductivity can be estimated for composites based on the "rule of mixtures." In other words, the properties of the composite are the sum of the properties of the constituent materials times their volume fraction.

DETAILED DESCRIPTION OF THE PREFERRED EMBODIMENT

Figure 1A:
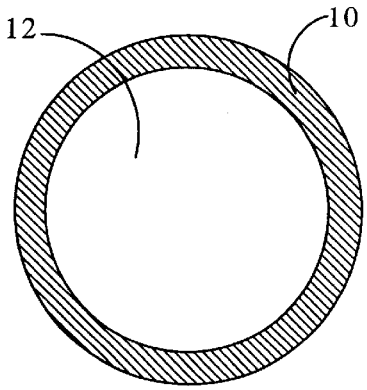
FIGS. 1A through 1D are schematics showing various embodiments of gun barrels of the present invention.

A composite gun barrel of the present invention is generally shown in the Figures as reference numeral 10.

The composite gun barrel 10 of the present invention comprises a mixture of aluminum with diamond particles.

The diamond particles selected are preferably Type IB monocrystalline diamonds with a maximum size of about 2.0 $\mu$m.

The diamond particles may occupy a volume fraction in the mixture in the range of 5% to 80%.

Preferably, the diamond particles occupy a volume fraction in the mixture in the range of about 20% to about 65%.

Most preferably, the diamond particles occupy a volume fraction in the mixture in the range of about 30% to about 40%. This reflects a balance between increased strength, increased thermal conductivity, and loss in ductility (plastic deformation) as the volume fraction of diamond increases (diamond does not have any plastic deformation—it is elastic to failure).

FIG. 1 shows the composite gun barrel 10 with bore 12.

Figure 1B:
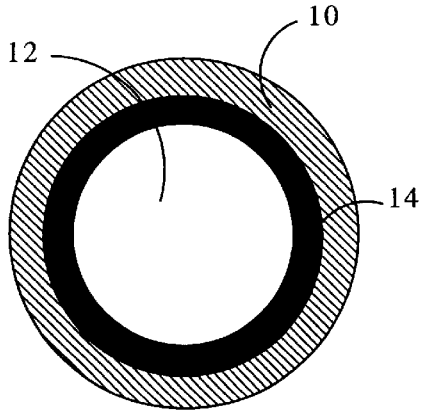

In a second embodiment, shown in FIG. 1B, the gun barrel 10 may have an inner steel liner 14. "Inner" refers to the direction toward the bore.

Figure 1C:
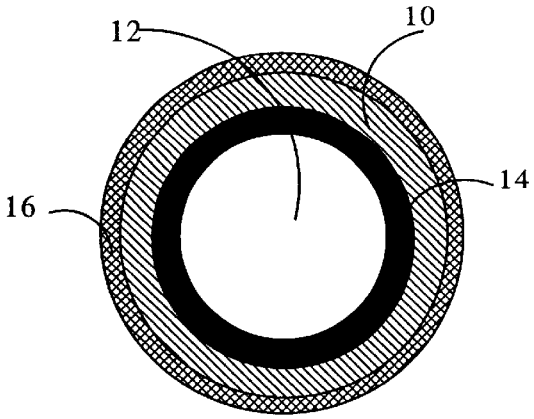

In a third embodiment, shown in FIG. 1C, the gun barrel 10 may have both an inner steel liner 14 and an outer layer 16 of carbon fibers. "Outer" refers to the direction away from the bore.

Figure 1D:
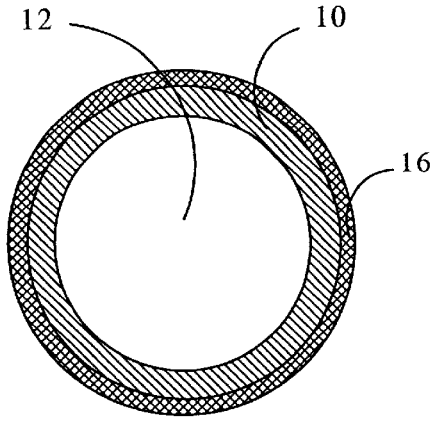

In a fourth embodiment, shown in FIG. 1D, the gun barrel 10 may have an outer layer 16 of carbon fibers.

The novel physical properties of the composite are its high resistance to deformation and fracture (yield strength), high stiffness (Young's modulus), high thermal conductivity, and low coefficient of thermal expansion.

Figure 2:
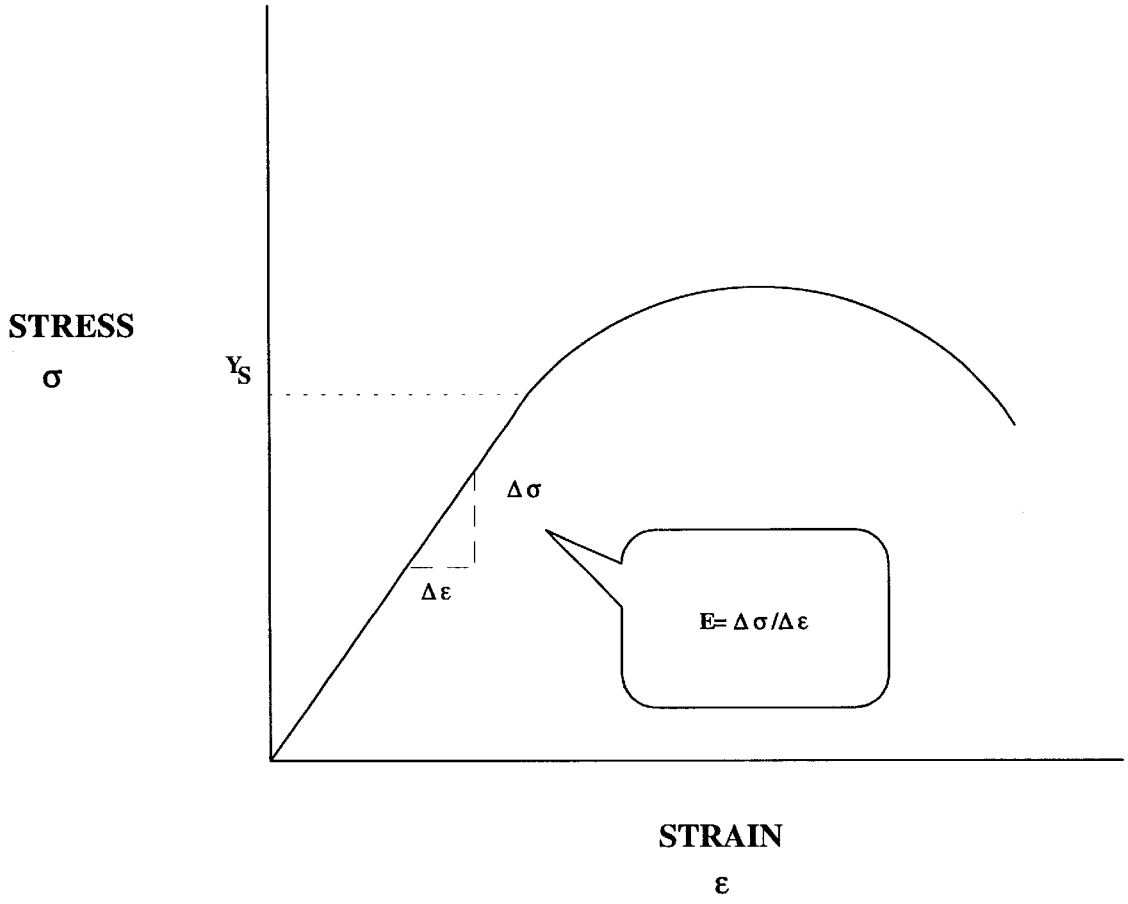
FIG. 2 is a chart showing the calculation of Young's modulus and yield strength.

The yield strength ($Y_s$) of a material is defined as that point on the stress vs. strain curve (FIG. 2) at which the curve ceases to be linear. The ratio of stress (force per area) to strain (change in length per original length) is known as the Young's modulus, i.e., the slope of the stress vs. strain curve.

Figure 3:
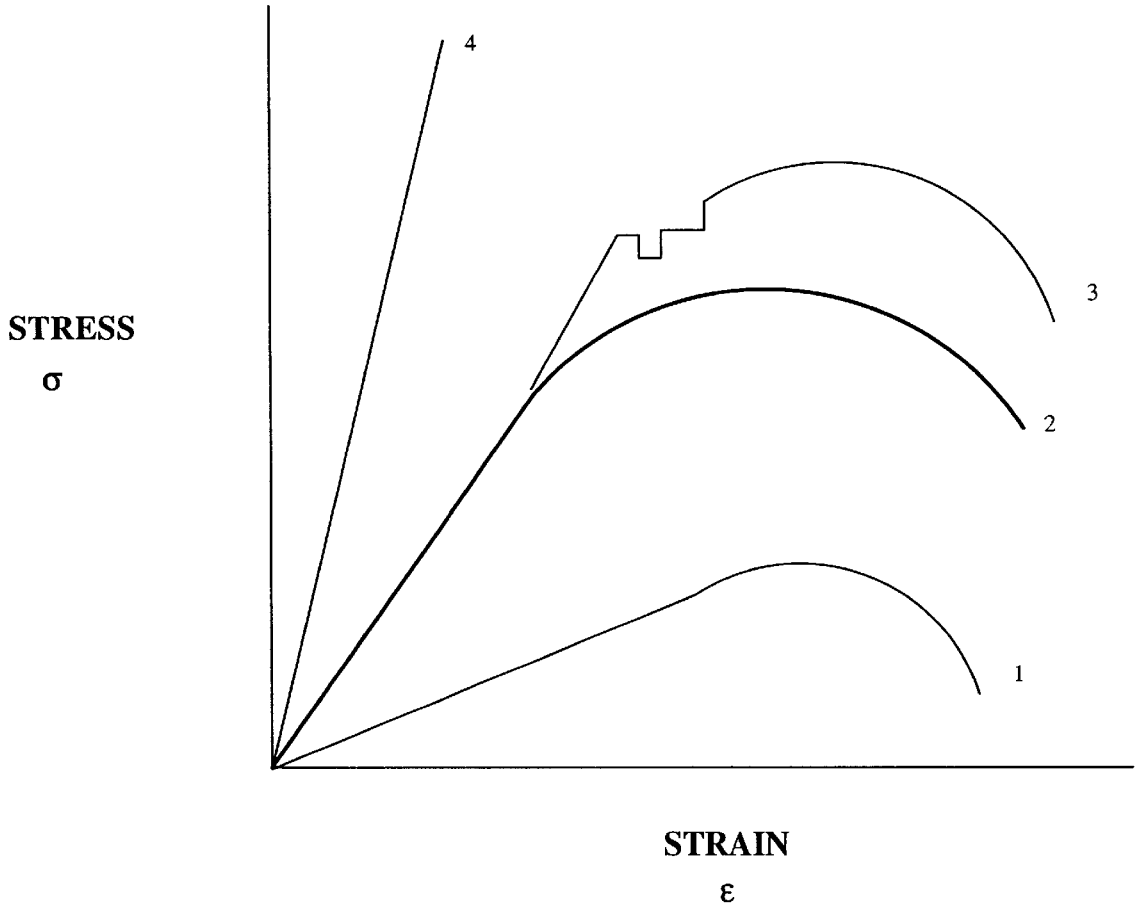
FIG. 3 is a chart illustrating the Young's modulus and yield strength for the present invention and for other materials.

FIG. 3 shows the relative Young's modulus and yield strength of various materials. Curve 1 is for pure aluminum. Curve 2 is for the aluminum/diamond composite (40%) of the present invention. Curve 3 is for steel. Curve 4 is for pure diamond. The "rule of mixtures" predicts that the intrinsic material properties of a material, such as Young's modulus and thermal conductivity, will be the sum of the properties of the constituent materials times their volume fraction. FIG. 3 thus predicts that the Young's modulus of the aluminum/diamond composite (40%) will be approximately midway between that of diamond and that of pure aluminum, approximating the Young's modulus of steel. FIG. 3 also predicts that the yield strength of the material will be much higher than that of pure aluminum (3.5 ksi).

The following table lays out the predicted properties of a 40% diamond volume fraction aluminum composite:

| | |
|---|---|
| Young's Modulus | 28–30 Msi (equivalent to steel) |
| Yield Strength | 50–55 ksi (equivalent to 7075 aluminum) |
| Thermal conductivity | 240–300 W/mK (aluminum is 180 W/mK) |
| Coefficient of thermal expansion | 4–5 ppm/° F. (equivalent to graphite) |

Actual values will be determined by experimental studies.

The material should also maintain its stiffness at elevated temperatures better than steel.

Decreasing the mass of material (from steel to aluminum) and increasing its stiffness (from aluminum) should result in shifting the first harmonic of oscillation of the gun barrel to a higher frequency, increasing the accuracy of the projectile fired from the barrel. The aluminum/diamond composite material should also have a higher dampening coefficient than steel.

METHOD OF MANUFACTURE

The aluminum/diamond composite of the present invention may be manufactured in at least two different ways.

For volume fractions (diamond) up to about 25%, simple melt mixing and direct squeeze casting processes may be used to produce finished parts; however, for volume fractions greater than about 25%, it is generally necessary to infiltrate a porous preform of particles using pressure, and then form parts using semi-solid casting methods.

Figure 4:
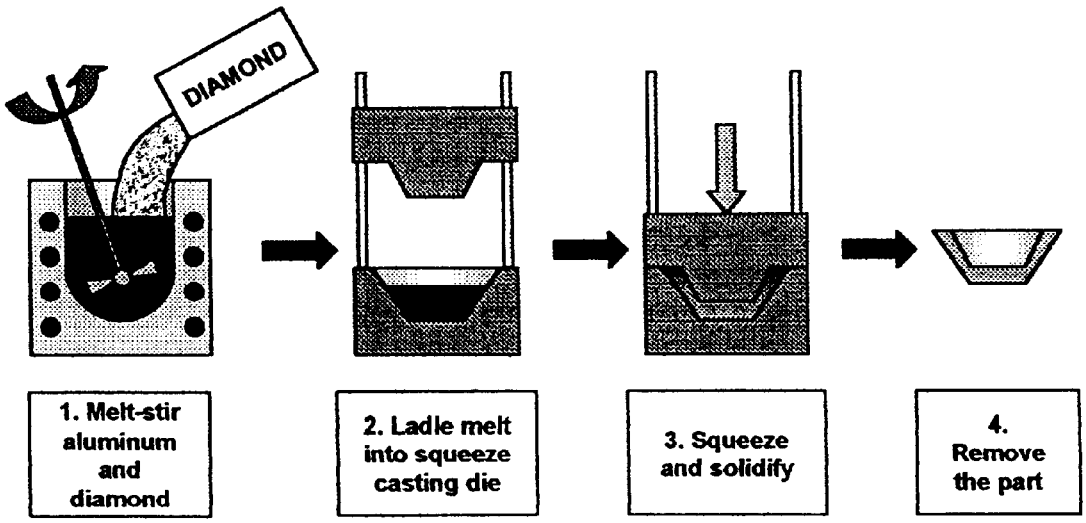
FIG. 4 is a schematic showing a first embodiment of a method of manufacture.

Up to about 25% (diamond) volume fraction, the material will remain relatively fluid at temperatures above the melting point of aluminum. Therefore, it is possible to simply pour diamond particles into molten aluminum and blend the materials using a mixing apparatus. The melt may then be ladled into a die and parts formed using direct squeeze casting. This method is illustrated in FIG. 4.

Figure 5:
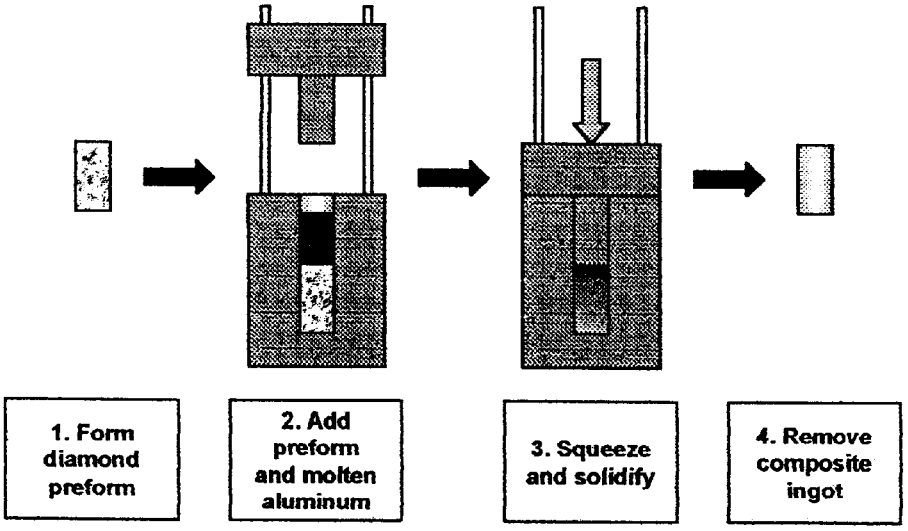
FIGS. 5 and 6 are schematics showing a second embodiment of a method of manufacture.
Figure 6:
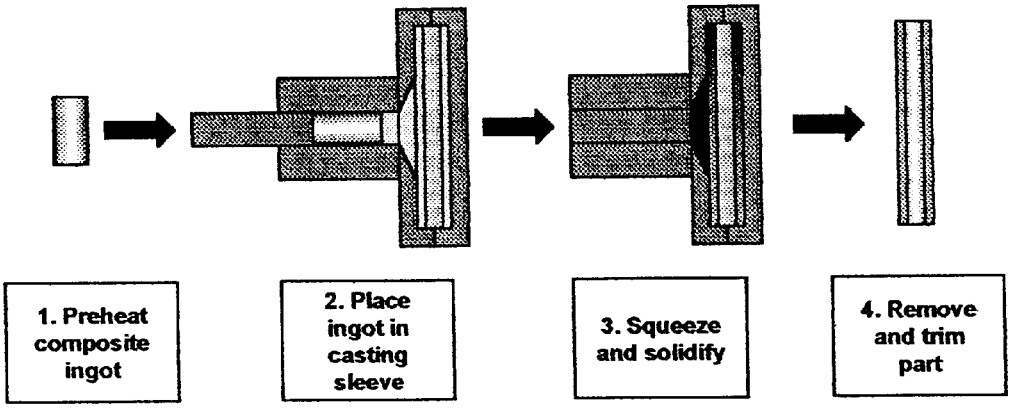

In order produce composites with volume fractions (diamond) greater than about 25%, a two step process will be necessary because the material will not flow (even above the melting temperature of aluminum). In the first step (FIG. 5), a preform of diamond particles will be produced that is approximately 60% porous. The preform will then be preheated (if needed) and placed in a direct squeeze casting machine, and then it will be infiltrated with molten aluminum to produce a composite ingot. In the second step (FIG. 6), the ingot can then be used in a semi-solid casting process to produce finished parts.

In the case of gun barrels, a steel liner can be incorporated into the semi-solid casting process to produce a finished barrel.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A composite gun barrel, comprising a mixture of aluminum with diamond particles, wherein the volume fraction of diamond particles is in the range of 5% to 80%.

2. The gun barrel of claim 1, wherein the volume fraction of diamond particles is in the range of about 20% to about 65%.

3. The gun barrel of claim 2, wherein the volume fraction of diamond particles is in the range of about 30% to about 40%.

4. The gun barrel of claim 1, further comprising an inner steel liner.

5. The gun barrel of claim 4, further comprising an outer layer of carbon fibers.

6. The gun barrel of claim 1, further comprising an outer layer of carbon fibers.

7. The gun barrel of claim 1, having a Young's modulus of about 28–30 million pounds per square inch.

8. The gun barrel of claim 1, having a yield strength of about 50–55 thousand pounds per square inch.

9. The gun barrel of claim 1, having a thermal conductivity of about 240–300 watts per meter Kelvin.

10. The gun barrel of claim 1, having a coefficient of thermal expansion of about 4–5 ppm per degree Fahrenheit.

* * * * *